US007193488B2

(12) United States Patent
Mayer

(10) Patent No.: US 7,193,488 B2
(45) Date of Patent: Mar. 20, 2007

(54) R SWITCH

(75) Inventor: Bernd Mayer, Munich (DE)

(73) Assignee: Tesat-Spacecom GmbH & Co. KG, Backnang (DE)

( * ) Notice: Subject to any disclaimer, the term of this patent is extended or adjusted under 35 U.S.C. 154(b) by 33 days.

(21) Appl. No.: 10/519,730

(22) PCT Filed: Jul. 11, 2003

(86) PCT No.: PCT/DE03/02343

§ 371 (c)(1),
(2), (4) Date: Feb. 8, 2005

(87) PCT Pub. No.: WO2004/008567

PCT Pub. Date: Jan. 22, 2004

(65) Prior Publication Data

US 2005/0237128 A1 Oct. 27, 2005

(30) Foreign Application Priority Data

Jul. 11, 2002 (DE) ..... 102 31 559

(51) Int. Cl.
*H01P 1/10* (2006.01)
*H01P 5/12* (2006.01)

(52) U.S. Cl. ..... 333/106; 333/108

(58) Field of Classification Search ..... 333/106, 333/108, 258, 34
See application file for complete search history.

(56) References Cited

U.S. PATENT DOCUMENTS 4,806,887 A * 2/1989 Au-Yeung ..... 333/106
6,218,912 B1 4/2001 Mayer ..... 333/106

FOREIGN PATENT DOCUMENTS

DE 37 02 416 8/1987

* cited by examiner

*Primary Examiner*—Dean Takaoka
(74) *Attorney, Agent, or Firm*—Jordan and Hamburg LLP

(57) ABSTRACT

An R switch with a stator and a rotor with three paths wherein a central, straight interconnection is constructed as step transformers and formed bar-like by recesses incorporated laterally in the in the steps of the transformers in order to lower the low frequency limit of the HF signals which can be transmitted.

8 Claims, 5 Drawing Sheets

R SWITCH

BACKGROUND OF THE INVENTION

The invention provides an R switch for switching connections between microwave waveguides on and off which has a structure which widens bandwidth by lowering the resonance frequencies of interconnections not in use thereby reducing coupling.

The European patent 0 276 582 discloses such an R switch with a stator, a rotor and three interconnections constructed as step transformers. In designing the R switches known from the art, it was totally disregarded that the non-active interconnections of these switches formed short-circuited cavities, which act as cavity resonators at certain frequencies. At these frequencies, the active paths, are affected so strongly that there is practically no longer any insulation between microwave waveguide, which is not connected, nor, with that, is there an error-free signal transmission. A resonance frequency of the non-active, curved paths is greater here than that of the nonactive straight interconnections, so that these two resonance frequencies limit a bandwidth of HF signals, which can be transmitted error-free by the R switches and, with that, limit the HF signals, which can be switched through.

SUMMARY OF THE INVENTION

In accordance with an embodiment of the present invention there is provided an R switch for switching connections between microwave waveguides on and off which has a parallelepiped stator having four side surfaces of which each have a central opening for connecting to a microwave waveguide. A rotor is disposed in an interior of a stator with its axis of rotation coaxial with a longitudinal axis of the stator and has a centrally disposed straight interconnection and two curved paths, i.e., interconnections, on either side thereof. Openings of the straight interconnection and curved paths are disposed in such a manner that, depending on a rotational position of a rotor, each opening can be connected using the straight interconnection or using one of the curved paths to each of the other three openings. The straight interconnection is constructed as a step transformer, and the step transformer of the straight interconnection is formed bar-like by recesses incorporated in the steps.

According to a feature of the present invention, the above-described R switch or the present invention, has an easily realized bar-like construction of a straight interconnection, constructed as a step transformer, that is constructed multi-stepped and that recesses are incorporated on either side of the last step of a step transformer. The invention objective of expanding bandwidth is easily carried out in production and can be realized inexpensively using a milling machine. In an embodiment of the invention the recesses are constructed on both sides of the last step.

The present invention includes an embodiment wherein the recesses are constructed on one side or the last step. Optionally, the invention provides a preferred embodiment wherein the recesses are constructed on both sides of the last step.

According to a further, advantageous development of the present invention, recesses are incorporated on either side of all steps in the step transformer of the straight interconnection, as a result of which a further lowering of a low-frequency limit of the R switch is possible.

According to a further advantageous development of the present invention, multi-step, bar-like constructions are formed as step transformers in curved paths and recesses are incorporated on either side of a last step of the step transformers of the curved recesses.

The present invention enlarges the bandwidth and is easily carried out in production and can be realized inexpensively using a milling machine.

According to a further, advantageous development of the present invention, recesses are incorporated on either side of all steps in the step transformer of the curved paths, as a result of which a further additional lowering of a low-frequency limit of the R switch is possible.

According to a further advantageous development of the present invention, a straight interconnection is constructed as a step transformer, in order to save material and weight, by omitting the step transformers in the curved paths, to the extent to which this is permitted by uncoupling.

Further advantages and advantageous developments of the present invention can be realized from the following description, the drawings and the claims.

Some examples of the invention are described in greater detail in the following and shown in the drawings

DESCRIPTION OF THE PROFFERED EMBODIMENTS

Figure 1:
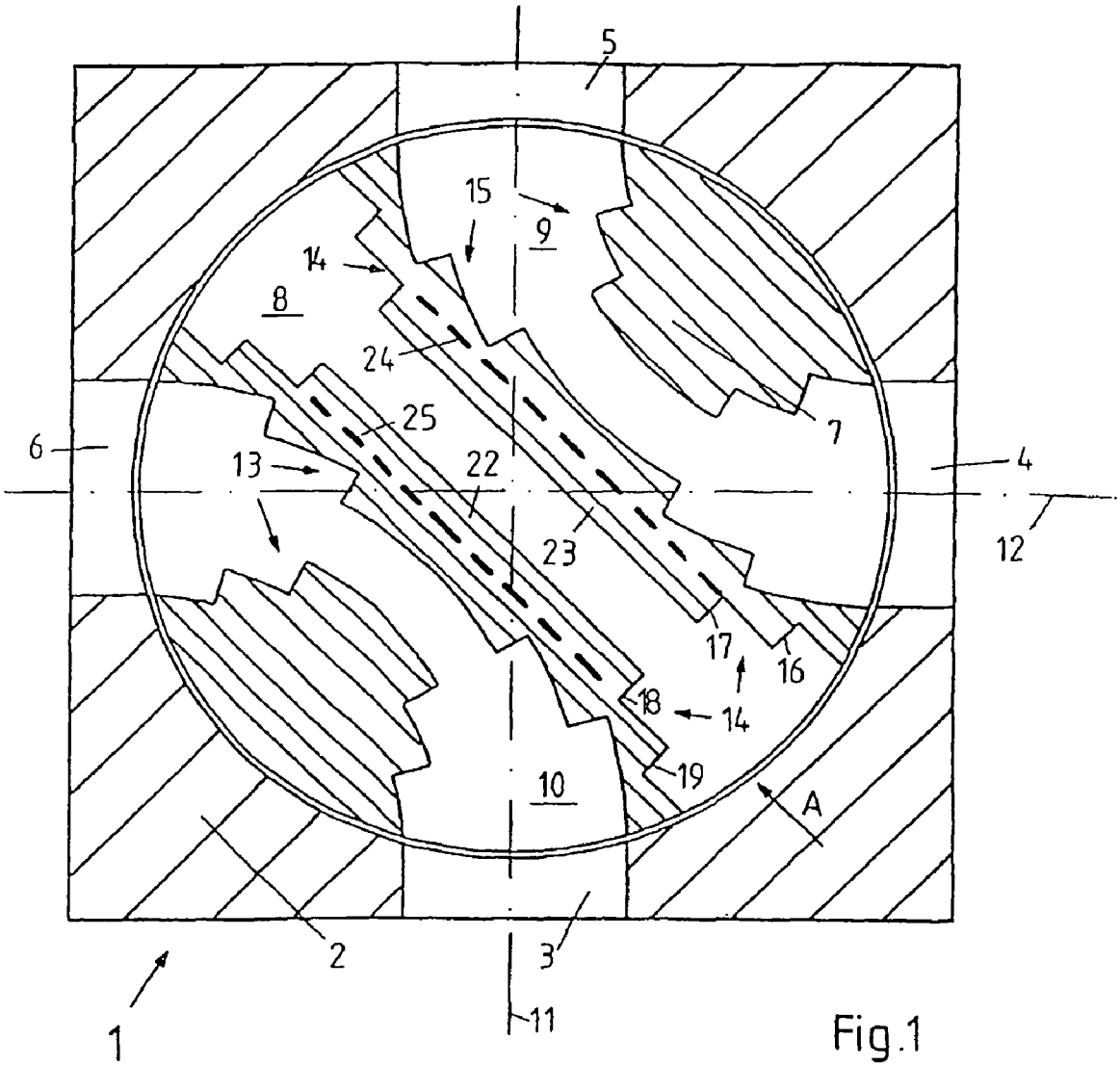
FIG. 1 is a sectional representation along the line I—I in FIG. 2 through an R switch of the present invention with a first bar-like configuration of a step transformer in a straight interconnection of a rotor.

FIG. 1 shows the transverse sectional representation of an R switch 1, which has of a stator 2 with end openings 3 to 6 for connecting waveguides, which are not shown in the Figure, and of a rotor 7, which is disposed rotatably in stator 2, with a central straight interconnection 8 and, on either side thereof, "curved" paths, i.e. interconnections, 9 and 10, ends of which are parallel to axes 11 and 12, which are at right angles to one another. The axes 11 and 12 also represent orientations of the waveguides adjoining the R switch 1. Depending on a position of the rotor 7, different waveguides, attached to the openings 3 to 6 of the stator 2, are connected through. In the case of the position of the rotor 7, shown in FIG. 1, the openings 4 and 5 and the openings 3 and 6 are connected with one another. Rotating the rotor 7 clockwise through 45° connects the openings 3 and 5 with one another. If the rotor 7 is rotated clockwise by a further 45°, the waveguides, connected to the openings 5 and 6 and the waveguides, connected to the openings 3 a 4, are connected through. If the rotor 7 is rotated once again clockwise through 45°, an interconnection is created between the openings 4 and 6. If the rotor 7 is rotated further clockwise by 45°, the arrangement of FIG. 1 is obtained once again.

DESCRIPTION OF THE PREFERRED EMBODIMENTS

As far as dimensioning of the R switch 1 perpendicularly to a plane of the drawing is concerned, the stator 2 has essentially the shape of a parallelepiped and the rotor 7 has the shape of a cylinder. In order to reduce the external dimensions of the R switch 1 as far as possible for use in satellites and space vehicles, the interconnection 8 and the interconnects 9 and 10 are constructed as step transformers 13, 14, 15, as a result of which especially space required by central parts of the interconnection 8 and the interconnects 9 and 10 is reduced.

Figure 2:
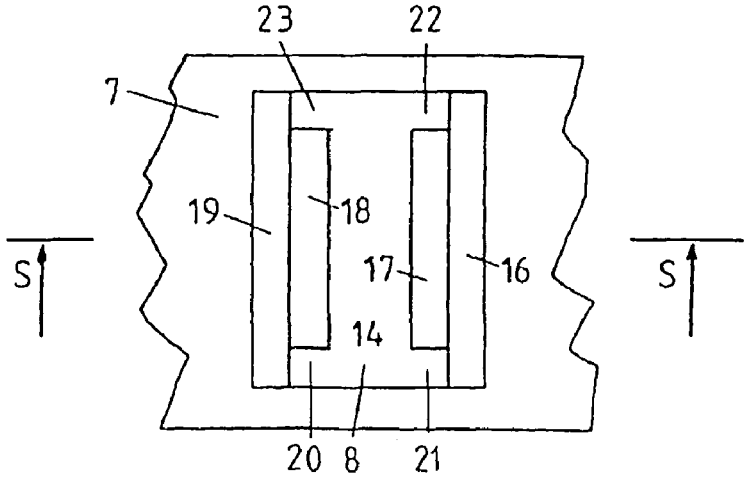
FIG. 2 shows a front view of the straight interconnection of the rotor of FIG. 1 in the direction II.

As indicated in FIG. 2, the interconnection 8 as well as the interconnects 9 and 10 have a rectangular cross-section, so that the side walls of the step transformers 13, 14, 15 have a shape of stairsteps. A front view of the straight interconnection 8 in the direction A of FIG. 2 consequently shows the front surfaces of the steps 16 to 19 of the step transformer 14.

According to the example of the present invention, shown in FIGS. 1 and 2, the upper steps 17 and 18 of the step transformer 14 have the shape of narrow bars, which can be achieved because recesses 20 to 23, which are drawn in FIG. 1 by broken lines 24 and 25 as undercuts, are milled on either side of the steps 17 and 18 to form recess spaces between the 17 and 18 and walls of the interconnection.

In principle, a rotor switch has the disadvantage that the interconnection or path, which does not connect any stator openings with one another, acts as a cavity resonator, which is supplied with energy over the unavoidable gap between the rotor 7 and the stator 2. Accordingly, for the rotor position of FIG. 1, the straight interconnection 8 acts as a cavity resonator. Since it is brought about by these means that signals nevertheless are transmitted between the interconnects, which are not connected through, such as between the interconnects 3 and 4 or the interconnects 5 and 6 of the present example, the bandwidth of the signals, which can be switched through error-free by an R switch, is limited by these resonance frequencies. The lower limiting frequency is formed here by a resonance frequency of the straight interconnection 8 and a resonance frequency of the curved interconnects 9 and 10 (here, for example, by rotating the rotor 7 clockwise through 45°, when the interconnects 9 and 10 are not active).

Extensive experiments have now shown that the resonance frequency of the straight interconnection 8, acting as a lower limiting frequency of the R switch 1, can very easily be decreased appreciably in order to enlarge the bandwidth of the signals, which can be transmitted error-free by the R switch 1, by forming the step transformer 14, as shown in FIGS. 1 and 2, at least partially bar-shaped by milling recesses 20 to 23 at the side of the steps 17 and 18.

For example, in the case of a particular R switch with the name WR51 switch, which had a bandwidth of 19 to 22 GHz without the bar-like construction of the step transformer, is was possible to expand the bandwidth to 17.7 to 22 GHz in this way. This is of advantage particularly because the satellite band extends from 17.7 to 22 GHz, so that the WR51 switch, after being modified pursuant to the present invention, can be used without problems for switching signals lying within the satellite band.

Figure 3:
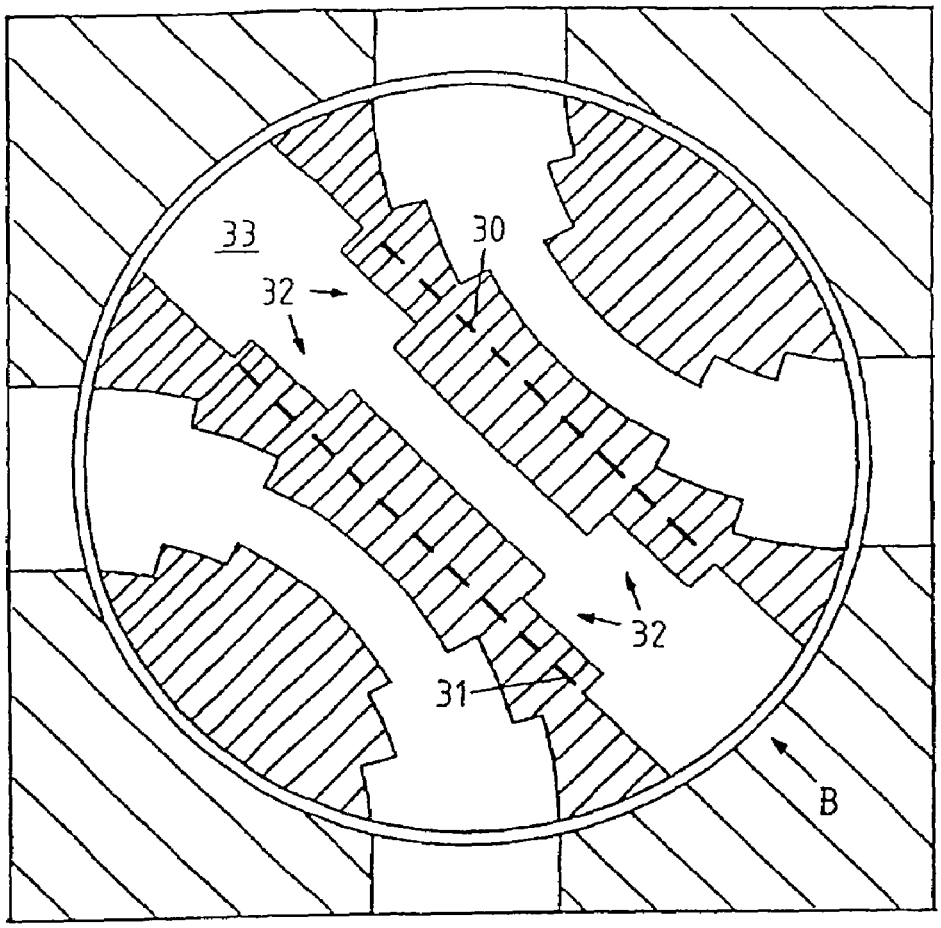
FIG. 3 shows a cross-section along the line III—III of FIG. 4 through an R switch with a second bar-like configuration of the step transformer in the straight interconnection.
Figure 4:
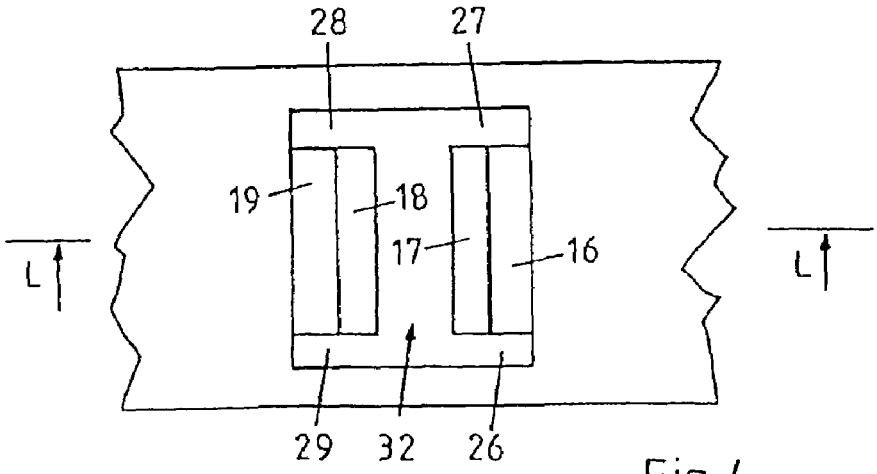
FIG. 4 shows a front view of the straight interconnection of the rotor of FIG. 3 in the direction IV

A development of the present invention for expanding the bandwidth of an R switch is shown in FIG. 3 in section along the line III—III drawn in FIG. 4 and in FIG. 4 as a plan view in the direction IV of the sectional representation shown in FIG. 3. In particular, FIG. 4 shows that, contrary to FIG. 2, recesses 26 to 29 are milled not only at the sides of steps 17 and 18, but also at the sides of steps 16 and 19 from the step transformer 32. In the sectional representation of FIG. 3, this is indicated by means of broken lines 30 and 31. The advantage of this is a further lowering of the resonance frequency of the straight interconnection 33, which is inactive and acting as a cavity resonator, for example, as in FIG. 3, and, with that, a further lowering of the lower limiting frequency of the R switch 34. In other respects, the construction and mode of action of the R switch, shown in FIGS. 3 and 4, is identical with the construction and mode of action of the R switch, shown in FIGS. 1 and 2, so that these do not have to be described again.

Further developments of the present invention for expanding the bandwidth of an R switch are shown in FIGS. 5 to 8. The advantage of this development is the fact that the low resonance frequency of the curved interconnects is lowered, when these are switched inactive by a rotation of the rotor and accordingly act as cavity resonators. The construction and mode of action of the R switch, in other respects, are identical with those of the R switch of FIGS. 1 to 4.

Figure 5:
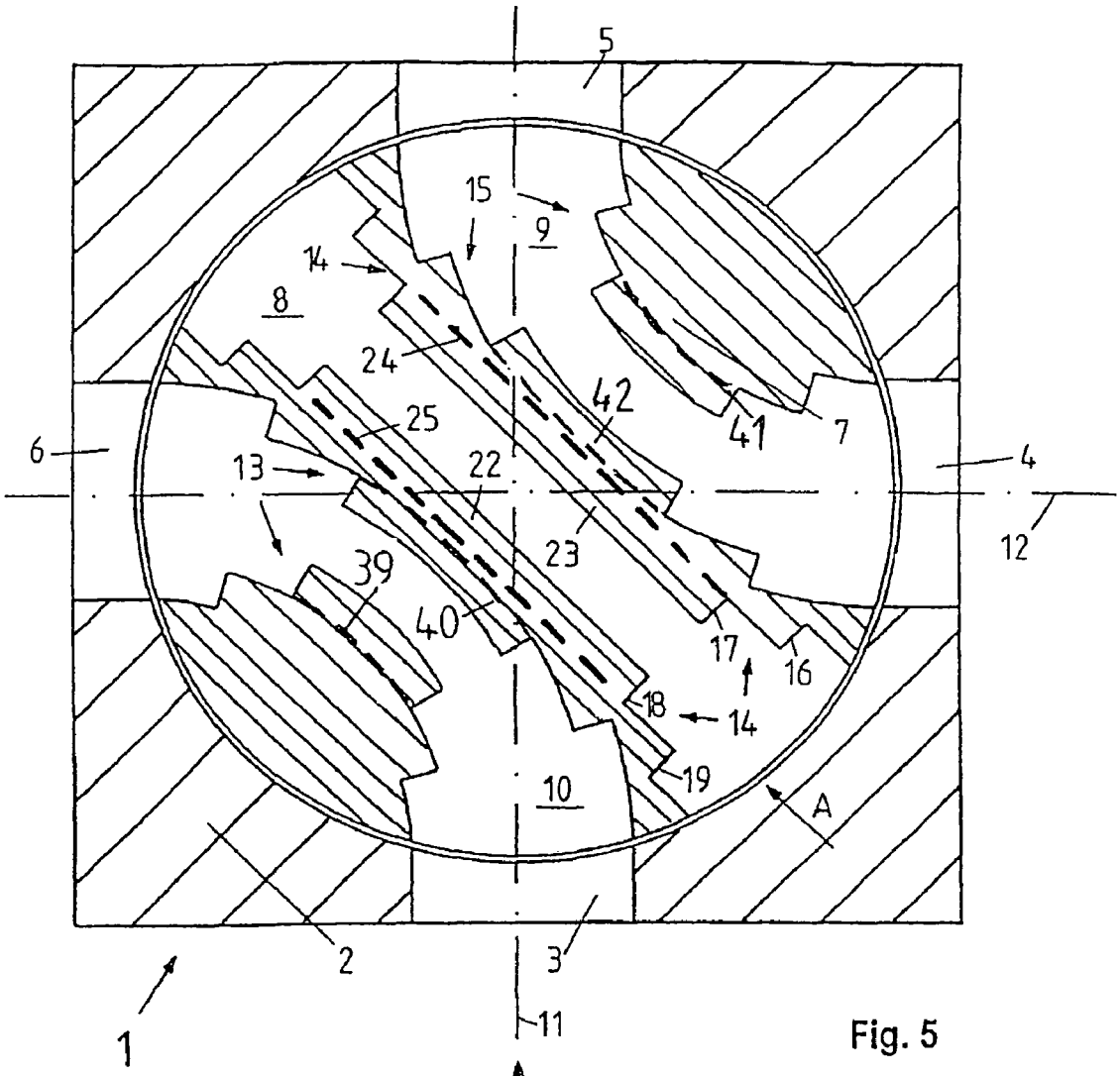
FIG. 5 shows a sectional representation along the line V—V in FIG. 6 through an R switch with a first bar-like configuration of a step transformer in straight interconnection and/or the curved path of a rotor.
Figure 6:
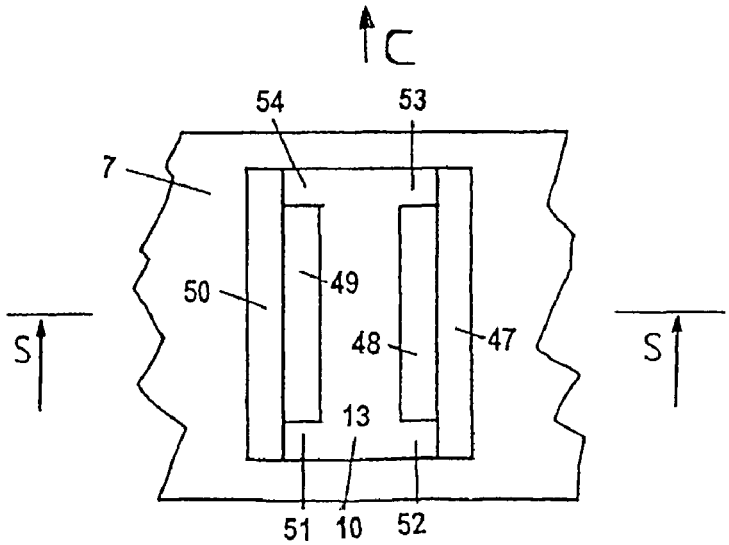
FIG. 6 shows a front view of the straight interconnection or the curved path of the rotor of FIG. 5 in the direction VI.

FIG. 5 corresponds to FIG. 1 and, additionally, has recesses 51, 52, 53, 54, as shown in FIG. 6, in the steps 48, 49 in the step transformers 13, 15 in the curved interconnects 9, 10, which are represented in FIG. 5 by means of broken lines 39, 40, 41 and 42 as undercuts.

Figure 7:
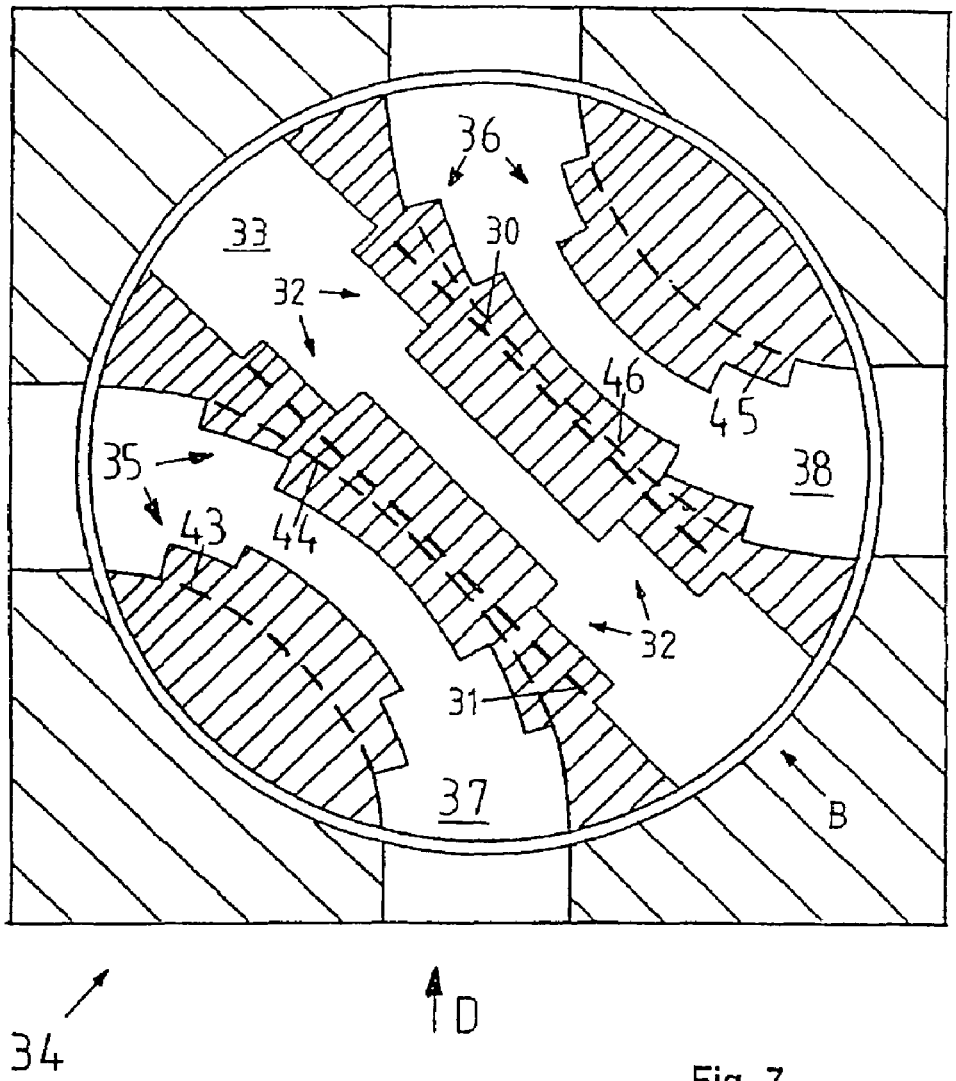
FIG. 7 shows a cross-section along the line VII—VII in FIG. 8 through an R switch with a second bar-like configuration of the step transformer in the straight interconnection and/or curved paths.
Figure 8:
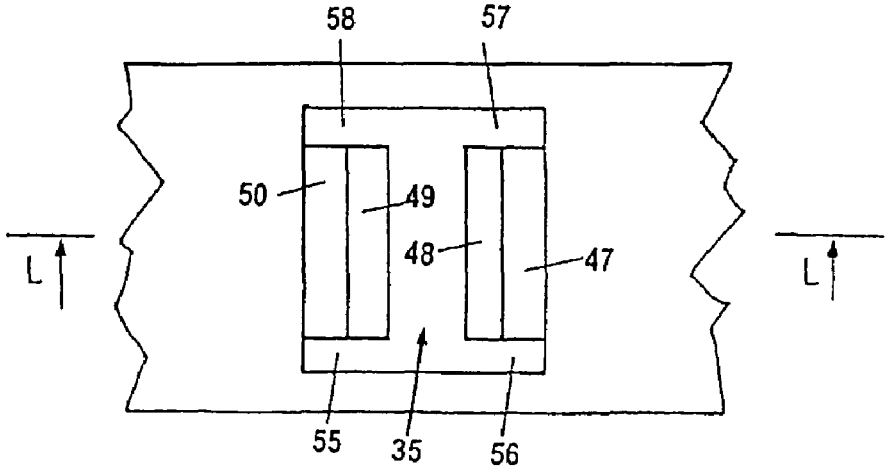
FIG. 8 shows a front view of the straight interconnection or the curved paths of the rotor of FIG. 7 in the direction VIII.

FIG. 7 corresponds to FIG. 3 and, additionally, has recesses 55, 56, 57, 58 as shown in FIG. 8 in the steps 47, 48, 49, 50 in the step transformers 35, 36 in the curved interconnects 37, 38, which are shown in FIG. 7 by means of broken lines 43, 44, 45 and 46 as undercuts.

Figure 9:
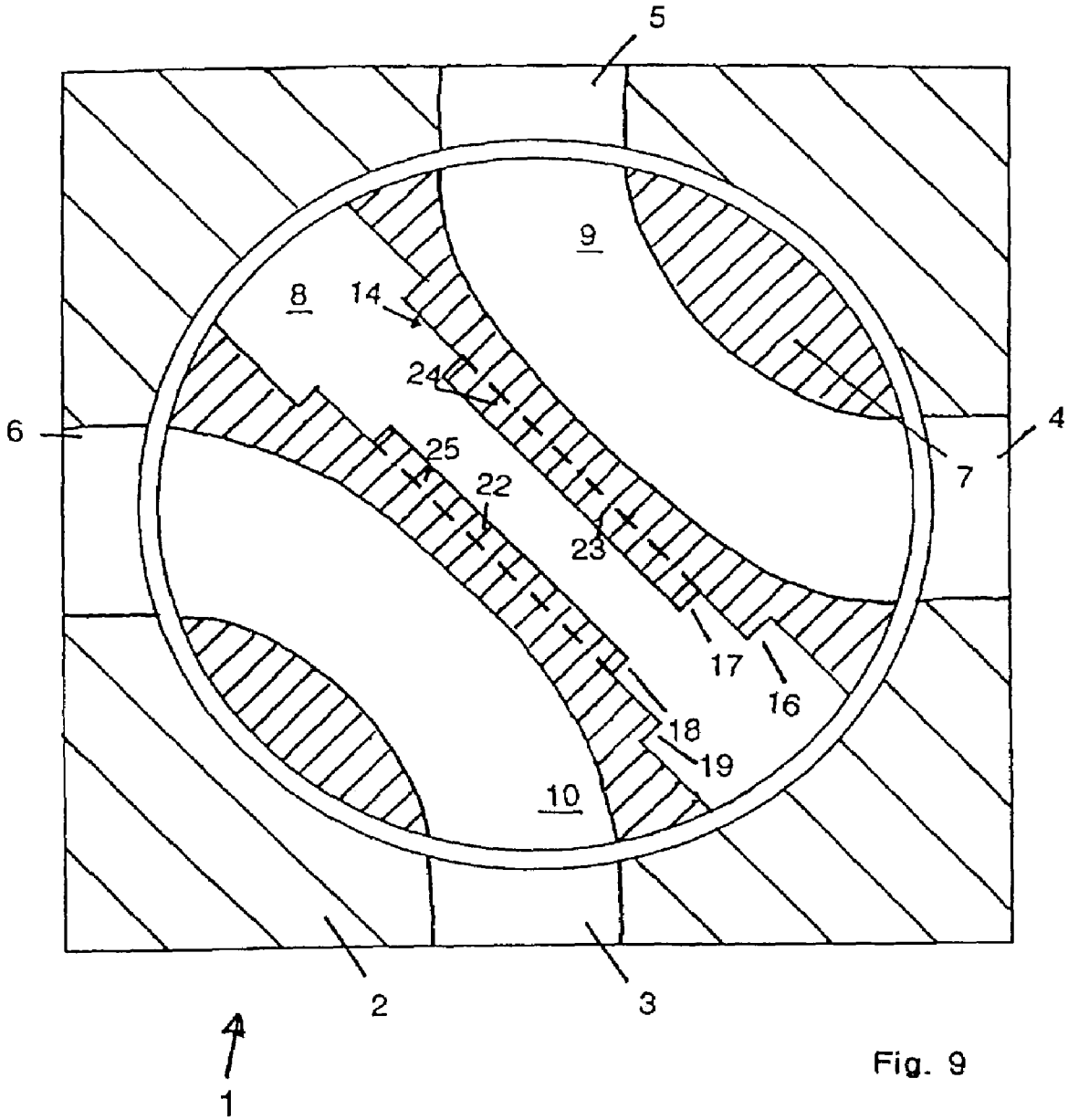
FIG. 9 shows a sectional representation along the line I—I in FIG. 2 through an R switch of the present invention with a first bar-like configuration of a step transformer in the straight interconnection of the rotor.

FIG. 9 corresponds to FIG. 1; however, the curved interconnects 9, 10 do not contain any step transformers.

All distinguishing features, shown in the specification, the claims below and in the drawings, are inventive individually as well as in any combination with one another.

The invention claimed is:

1. An R switch for switching connections between microwave waveguides, comprising:

a stator having an interior cavity and four connection openings communicating with said interior cavity, each of said connection openings being respectively disposed on one of four side surfaces of said stator, said side surfaces being arrange in opposing pairs, said connection openings being configured to connect to the microwave waveguides;

a rotor rotatably disposed in the interior cavity;

said rotor having a centrally disposed straight interconnection configured to interconnect opposing ones of said connections openings when said rotor is positioned at a first rotation position;

said rotor having first and second curved interconnections respectively disposed on opposing sides of the straight interconnection, said first curved path being configured to interconnect first and second connection openings of said connection openings which are disposed on adjacent ones of said four side surfaces when said rotor is positioned at a second rotation position different than said first rotation position, said second curved interconnection being configured to interconnect third and fourth connection openings of said connection openings which are disposed on other adjacent ones of said four side surfaces when said rotor is positioned at said second rotation position;

the straight interconnection being constructed as a step transformer, the straight interconnection having end openings, first and second opposing walls, and third and fourth opposing walls, and extending in a longitudinal direction between said end openings, and the step transformer of the straight interconnection being formed by opposing first and second steps on said first and second walls, and said first and second steps defining recess spaces between longitudinally extending step sides of said first and second steps and at least one of said third and fourth walls opposing said longitudinally extending sides.

2. The R switch of claim 1, wherein said first and second steps respectively have first step ends and second step ends and said recess spaces extend from said first step ends to said second step ends.

3. The R switch of claim 2, wherein the step transformer of the straight interconnection is constructed multi-stepped and the first and second steps are innermost steps of said step transformer.

4. The R switch of claim 3, wherein the step transformer of the straight interconnection is constructed multi-stepped and said recess spaces are defined by all steps in the step transformer including said first and second steps.

5. The R switch of claim 3, wherein steps of the step transformer of the straight interconnection other than said first and second steps do not define said recess spaces.

6. The R switch of claim 5, wherein said longitudinally extending step sides include sides on both longitudinal sides of each of all said steps and said recess spaces are defined between said longitudinally extending step sides and both of said third and fourth walls opposing respective ones of said longitudinally extending sides.

7. The R switch of claim 3, wherein said longitudinally extending step sides include sides on both opposing longitudinal sides of said first and second steps and said recess spaces are defined between said longitudinally extending step sides on both said sides and both of said third and fourth walls opposing respective ones of said longitudinally extending sides.

8. The R switch of claim 2, wherein said longitudinally extending step sides include sides on both longitudinal sides of said first and second steps and said recess spaces are defined between said longitudinally extending step sides on both said sides and both of said third and fourth walls opposing respective ones of said longitudinally extending sides.

* * * * *